US007445534B2

(12) United States Patent
Krieglmeyer et al.

(10) Patent No.: US 7,445,534 B2
(45) Date of Patent: Nov. 4, 2008

(54) METHOD OF SEALING A LAMP BY DEFORMATION OF A PINCH REGION USING HIGH-ENERGY RADIATION

(75) Inventors: Christoph Krieglmeyer, Hitzhofen/Hofstetten (DE); Christine Maier, Herbrechtingen (DE); Roland Mayer, Giengen (DE); Georg Rosenbauer, Wassertrüdingen (DE)

(73) Assignee: Patent-Trewhand-Gesellschaft für elektrische Glühlampen mbH, Munich (DE)

( * ) Notice: Subject to any disclaimer, the term of this patent is extended or adjusted under 35 U.S.C. 154(b) by 454 days.

(21) Appl. No.: 11/148,227

(22) Filed: Jun. 9, 2005

(65) Prior Publication Data

US 2005/0275349 A1 Dec. 15, 2005

(30) Foreign Application Priority Data

Jun. 9, 2004 (DE) ..... 10 2004 027 997

(51) Int. Cl.
*H01J 9/00* (2006.01)
*H01J 9/20* (2006.01)

(52) U.S. Cl. ..... 445/26; 445/27; 445/22

(58) Field of Classification Search ..... 445/22, 445/26, 27, 70, 73; 141/4–8, 65, 66; 53/79
See application file for complete search history.

(56) References Cited

U.S. PATENT DOCUMENTS

| | | | | |
|---|---|---|---|---|
| 2,914,371 | A * | 11/1959 | Wiedenmann | 445/27 |
| 4,709,187 | A | 11/1987 | Roche | |
| 4,746,316 | A * | 5/1988 | Sudo et al. | 445/43 |
| 4,756,701 | A | 7/1988 | Danko | |
| 5,484,315 | A | 1/1996 | Juengst et al. | |
| 5,681,198 | A * | 10/1997 | Peng et al. | 445/43 |
| 5,913,705 | A | 6/1999 | Kiesel | |
| 6,368,175 | B1 * | 4/2002 | Horiuchi et al. | 445/26 |

FOREIGN PATENT DOCUMENTS

| | | | |
|---|---|---|---|
| DE | 19623499 | | 12/1997 |
| DE | 19623499 | A1 | 12/1997 |
| EP | 1024515 | A1 | 8/2000 |
| EP | 1227510 | A1 | 7/2002 |
| GB | 800193 | A | 8/1958 |
| GB | 952240 | A | 3/1964 |
| RU | 1827365 | A1 * | 7/1993 |
| WO | WO 2005122206 | A2 | 12/2005 |

* cited by examiner

*Primary Examiner*—Mariceli Santiago
(74) *Attorney, Agent, or Firm*—William E. Meyer

(57) ABSTRACT

A method and apparatus for producing a lamp in the case of which a lamp bulb closed at one end is filled through a feed opening for a luminous means are disclosed together with a lamp produced using this method. A dome of the lamp bulb can thereby be of smooth design without a pumping tip.

2 Claims, 2 Drawing Sheets

METHOD OF SEALING A LAMP BY DEFORMATION OF A PINCH REGION USING HIGH-ENERGY RADIATION

TECHNICAL FIELD

The invention relates to a method for producing a lamp, preferably an incandescent lamp pinched at one end, having a lamp bulb, into which a luminous means and supply leads are inserted through a feed opening, the lamp bulb being sealed by pinching the region of the feed opening. In addition, the invention relates to an apparatus for carrying out such a method, and a lamp produced using such a method.

BACKGROUND ART

Such a method known, for example, from DE 196 23 499 A1 is used, for example, to produce halogen incandescent lamps. However, in principle, this method can also be used to produce lamps of another design, for example, discharge lamps. In the case of the known method, a bulb tube is firstly provided at an end face with a rounded dome at which an axially projecting pump tube fitting is constructed. Furthermore, the bulb tube is reshaped in a mold by blowing in inert gas to form a lamp bulb through whose open feed device a frame is inserted for which at least one filament and the supply leads are constructed. Furthermore, the pump tube fitting is partially severed such that a pump tube can be attached to the open tube that results. The feed opening for the frame is then sealed in a gas-tight fashion by a pinch, and the inner space enclosed by the lamp bulb is evacuated via the pump tube and filled with a filling gas containing halogens. In a concluding work operation, the pump tube is then melted off such that the lamp bulb is sealed and the two supply leads project from the pinch.

A similar method is also described in U.S. Pat. No. 4,756,701, in which, however, the configuration of the contour in the region of the dome cannot be so exactly executed as is the case in the prior art in accordance with DE 196 23 499 A1.

It is disadvantageous in the case of these solutions that an axial projection, the so-called pumping tip, always remains in the region of the dome owing to the melted-off pump tube, and can lead to shadows and interfering structures in the case of frontal illumination. It is disadvantageous, furthermore, that these known methods are relatively complicated, since the pump tube firstly has to be attached and severed again in a subsequent work step, and the remaining pumping tip must be sealed.

DISCLOSURE OF THE INVENTION

It is an object of the present invention to provide a method and an apparatus for carrying out this method and a lamp in the case of which the disadvantages described above are eliminated.

This object is achieved by a method for producing a lamp, having a lamp bulb, into which a luminous means and supply leads are inserted through a feed opening, the lamp bulb being sealed by pinching the region of the feed opening, wherein the filling of the lamp bulb is performed through the feed opening before the pinching.

Particularly advantageous refinements are to be found in the dependent claims.

According to the invention, the filling of a lamp bulb is not—as in the prior art—performed via a specifically attached pump tube, but via the feed opening that is present in any case and through which a luminous means has been fed into the lamp bulb. As a result of this solution, a dome of the lamp bulb that is remote from this feed opening can be designed with a smooth surface without a pumping tip, and so it is possible to significantly improve the end-face illumination by contrast with conventional solutions. In comparison to the generic methods, the production of the lamps is also simplified, since the separated work steps for constructing and severing/welding the pump tube can be eliminated.

It is preferred to carry out the filling and the pinching in the region of the feed opening in a space sealed in a gas-tight fashion, preferably in a pressure vessel in which both a holder for the lamp bulb, the luminous means and also the pinching device are arranged.

The filling can be performed by flooding the pressure vessel with the filling gas or via a suitable gas filling apparatus.

The method can be further simplified when the heating of the region of the lamp bulb that is to be pinched is performed by high-energy radiation, for example laser radiation. The laser itself can be arranged outside the space/pressure vessel, it being possible for the laser beam to enter the vessel interior via one or more laser windows.

It can be advantageous, depending on the lamp to be produced, to allow the laser beam to enter from two sides or one side, there being a need in the last-named case, at least, to rotate the lamp in order to heat the pinch region on both sides, while in the first-named case diametrically arranged surfaces are heated simultaneously.

The quality of the pinch seal can be substantially improved when a laser spot is deflected by means of a scanner in order to produce a predetermined beam profile that enables the pinch region to be directionally heated. This beam profile is set, for example, such that the intensity rises gradually toward the feed opening, that is to say toward the lower edge of the lamp bulb, in order to avoid radiation losses in this region. In the case when the lamp bulb is held via lamp pincers or the like, it is preferred to raise the intensity of radiation toward these lamp pincers, as well, in order to minimize radiation losses via the pinchers, such that continuous and uniform heating of the pinch region is ensured.

For halogen incandescent lamps, the lamp body is usually formed from silica glass—in order to minimize formation of $SiO_2$ (that is to say formation of $SiO_2$ vapor), and the laser power can be reduced as a function of the irradiation period. The $SiO_2$ vapor or quartz vapor produced during heating is preferably evacuated, for example, by means of an evacuation tube that is directed onto that region of the lamp vessel which is to be heated.

It emerged that a laser power between 300 watts and 2500 watts, and an irradiation period in the range from 2 seconds to 20 seconds suffice.

An important field of application of the method according to the invention consists in the production of so-called reflector lamps in which the lamp bulb is widened in the manner of a reflector and provided with a reflection layer, since no pumping tip that is inevitably produced in lamps produced using conventional methods is constructed in the region of a dome closing the reflector.

BRIEF DESCRIPTION OF THE DRAWINGS

The aim below is to explain the invention in more detail with the aid of exemplary embodiments and with reference to drawings, in which.

BEST MODE FOR CARRYING OUT THE INVENTION

The invention is explained below with the aid of low-volt halogen incandescent lamps. As already mentioned at the beginning, however, the application of the method according to the invention and of the apparatus according to the invention are not in any way restricted to such lamp types, but are selected here only by way of example.

Figure 2:
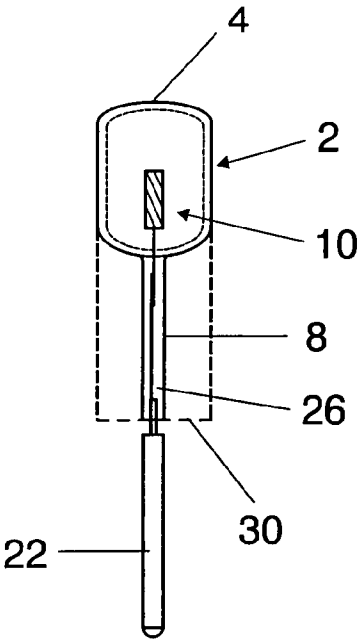
FIG. 2 shows a side view of the halogen incandescent lamp from FIG. 1.
Figure 1:
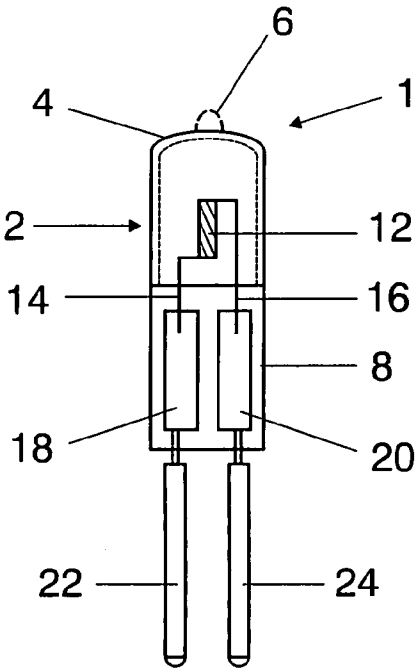
FIG. 1 shows a front view of a halogen incandescent lamp produced using the method according to the invention.
Figure 3:
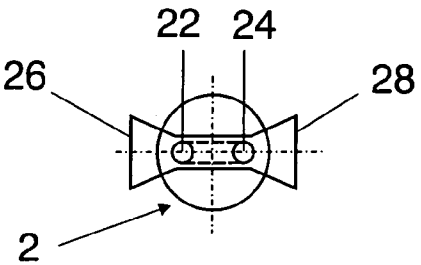
FIG. 3 shows a bottom view of the halogen incandescent lamp from FIG. 1.

FIGS. 1 to 3 show an exemplary embodiment of a halogen incandescent lamp that can be designed for low-volt operation or system voltage, and which can be used in the living room or as a built-in furniture luminaire.

The incandescent lamp 1 has a lamp bulb 2 that has approximately the shape of a hollow cylinder in the raw state (dashed in FIG. 2), an end section being formed by a spherically curved dome 4. By contrast with conventional halogen incandescent lamps, this dome is not provided with a pumping tip 6, which is indicated by dashes in FIG. 1, but is of smoothly flat design such that the end-face emission is not impeded. The lamp bulb 2 is produced from silica glass or from hard glass.

Constructed at the lower end section, in FIGS. 1 and 2, of the lamp bulb 2 is a pinch seal 8 via which a frame 10 is held in a gas-tight fashion in the lamp bulb 2. The frame 10 has a filament 12 whose axis runs coaxially with the lamp axis (vertically in FIG. 1). The filament wire forms two supply leads 14, 16 that are connected to the molybdenum foils 18, 20 arranged in the pinch seal 8. These foils are connected, for their part, to base pins 22, 24 which are situated outside the pinch seal 8. The pinching is performed via shaping pinching jaws such that in the side view in accordance with FIG. 2, the cylindrical base body is pressed flat thus resulting in accordance with figure 3 in a profile that is widened in the shape of a trapezoid at its outer narrow sides 26, 28. The profile, to be seen in FIG. 3, of the pinch 8 is determined by the geometry of the shaping pinching jaws.

The inner space of the lamp bulb 2 is filled in the case of halogen lamps with a filling gas that contains a fraction of a halogen (30 to 3000 ppm). The halogen cycle set up when the lamp is switched on is sufficiently well known, and so there is no need for explanations in this regard.

A particular feature of the above-described incandescent lamp 1 consists in that the evacuation and filling with filling gas is not—as is customary—performed via a pump tube applied to the pumping tip 6, but through the feed opening 30, open in the raw state (dashed in FIG. 2), of the lamp bulb 2 before pinching—no pumping tip 6 is required and the dome 4 can therefore be designed with high optical quality.

Figure 4:
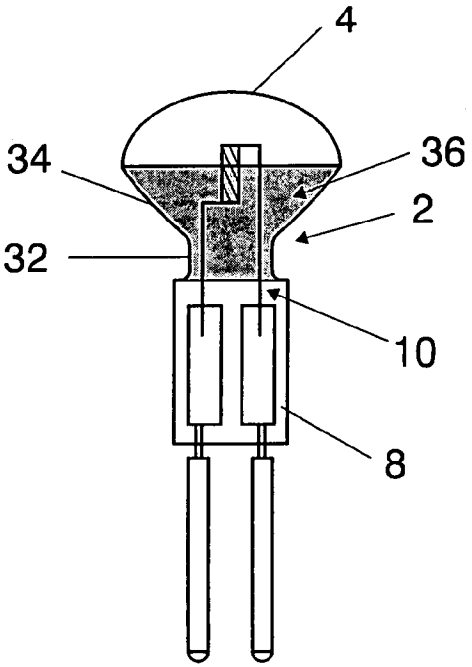
FIG. 4 shows a side view of a halogen reflector lamp produced using the method according to the invention.

FIG. 4 illustrates a variant of an incandescent lamp 1 designed as a halogen reflector lamp. The basic design of this lamp is the same as in the above-described exemplary embodiment, that is to say, a frame 10 is held in a lamp bulb 2, the lower end section of the lamp bulb 2 being sealed in a gas-tight fashion via the pinch seal 8. In contrast to the above-described exemplary embodiment, the pinch seal 8 merges into a neck 32 that then widens like a funnel to form a reflector 34 that is closed by the dome 4, which is likewise of spherical design but more strongly cambered. The funnel-shaped peripheral walls of the reflector 34 are provided with a silver coating 36 acting as reflection layer.

Both lamps (FIGS. 1 to 3; FIG. 4) can additionally be further provided with a special interference filter coating via which heat is retroreflected onto the filament such that less energy need be fed from outside in order to keep the filament at operating temperature. This infrared coating (IRC) enables a higher light yield and thus a saving of energy costs for operating the lamp. If such a coating is applied, the lamp bulb 2 is constructed with an elliptical cross section.

As mentioned at the beginning, the pinch and thus the gas-tight sealing of the lamp bulb 2 is performed downward in the prior art after the outer contour of the lamp bulb 2 has been shaped by means of shaping pinching jaws 35, via which the regions of the lamp bulb 2 which adjoin the pinch seal 8 can also be subsequently shaped. In the case of conventional solutions, heating to deformation temperature is usually performed by means of gas burners via which the region of the pinch seal 8 is heated.

Figure 5:
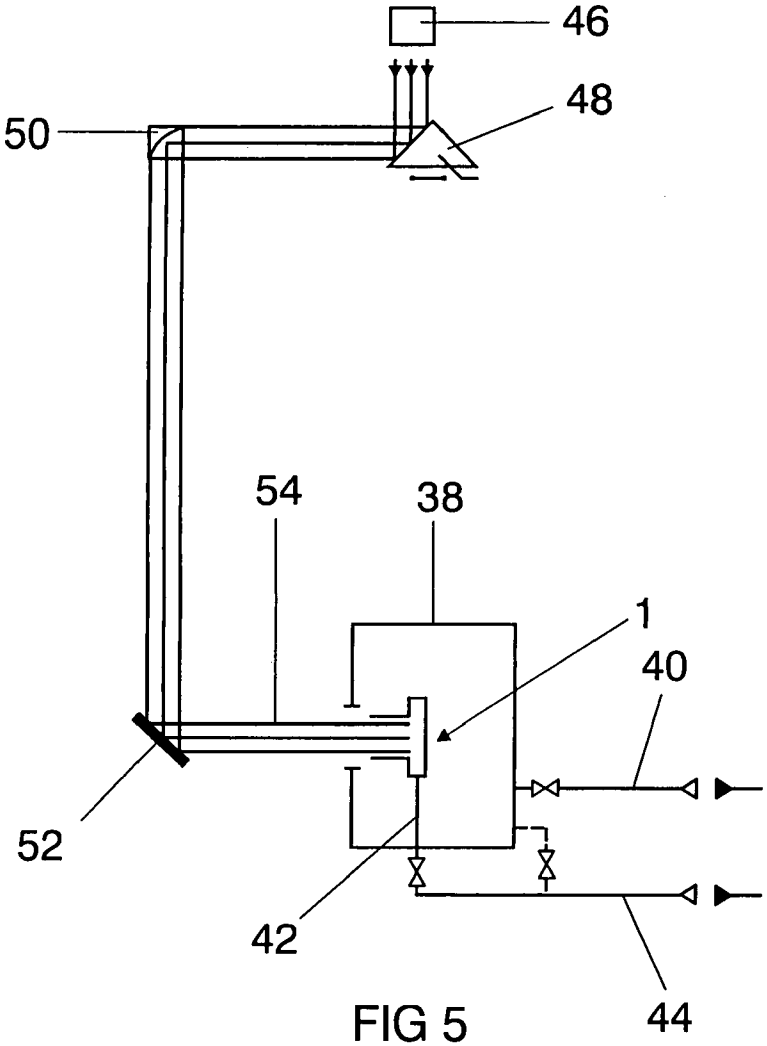

FIG. 5 shows an apparatus with which the method according to the invention can be carried out, in which case the lamp bulb 2 is filled from below via the feed opening 30, and the lamp bulb 2 is heated by means of laser radiation.

In accordance with FIG. 5, the apparatus has a pressure chamber 38 in which one or more of the incandescent lamps 1 that are to be filled and pinched are arranged. These are held via a device that is illustrated in more detail in FIG. 6.

The pressure chamber 38 can be filled with inert gas by means of an inert gas line 40, or evacuated. Furthermore, dipping into the pressure chamber 38 is a filling gas tube 42 that dips into the feed opening 30 that is illustated in FIG. 2 and is connected to a filling gas line 44.

As an alternative to the tube, it is also possible—as indicated by dashes—for the entire pressure chamber to be flushed via the filling gas line 44 such that it is possible to dispense with the tube 42.

A laser 46 is used to heat the pinch region, a $CO_2$ laser with a wavelength of 10.6 μm being employed in the illustrated exemplary embodiment—it also being possible, of course, for other laser types to be used.

The laser beam emitted by the laser 46 is directed onto the pinch region of the lamp bulb 2 through a laser window 54 of the pressure chamber 38 via a suitable focusing optical system comprising, for example, a prism 48, a parabolic mirror 50 and a swivelable scanner mirror 52. In the exemplary embodiment illustrated in FIG. 5, the laser beam enters the pressure chamber 38 on one side such that in each case it is also only one side of the lamp bulb 2 that is heated. Such a focusing optical system presupposes that the incandescent lamp 1 is held rotatably in the pressure chamber 38 such that the pinch region can be heated uniformly on both sides. It is possible to dispense with this rotatable bearing of the incandescent lamp 1 when the laser beam is split via the prism 48 into two component beams that then enter the pressure chamber 1 from left and right via two laser windows 54—that is to say the beam path illustrated in FIG. 5 is then reflected about the vertical axis. However, it can also be advantageous with this variant to rotate the incandescent lamp 1 during heating.

The drive of the scanner mirror 52 is controlled in such a way that the laser spot sweeps a predetermined area a, it being possible by controlling the scanner drive to set a predetermined beam profile via which the heating is controlled as a function of distance. This may be explained with the aid of FIG. 6.

Figure 6:
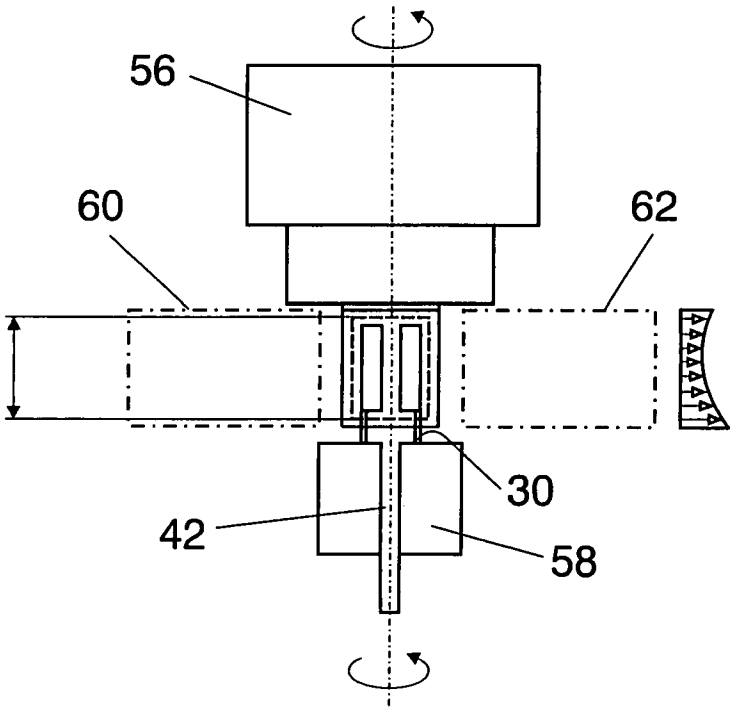
FIG. 5 shows a basic design of an apparatus according to the invention for carrying out the method and FIG. 6 shows a schematic of a lamp holder of the apparatus from FIG. 5.

FIG. 6 shows the incandescent lamp 1 in the clamped state, the area swept by the laser beam being indicated by dashes.

The non-deformed lamp bulb 2 (see FIG. 2) is held by a bulb rod 54 that can rotate about the vertical axis. The frame 8 introduced into the lamp bulb 2 through the feed opening 30 is held in its predetermined position relative to the lamp bulb 2 by a frameholder 58, which is likewise supported rotatably. Extending through the frameholder is the tube 42 through which the filling gas can be pressed into the interior of the lamp bulb 2.

Depending on the setup of the method (filling gas being fed via the tube 42 or by flushing the pressure chamber 38), the filling gas is set to a slight overpressure that can be between 190 and 300 mbar depending on lamp volume.

After or during the filling of the lamp bulb, the laser 46 is fired, and the bulb rod 56 as well as the frameholder 58 rotate synchronously at a rotational speed of between 180 to 600 rpm. The scanner mirror drive is controlled in this case such that a beam profile as indicated on the right in FIG. 6 is set. That is to say, the intensity profile rises slightly in the region of the bulb rod 56 in order to compensate radiation losses via the lower edge of the bulb. The intensity profile also rises toward the lower edge, that is to say, toward the feed opening 30, in order to compensate the radiation losses in this region—the result of which is to achieve a very uniform heating of the sections to be pinched. The irradiation period and the laser power are set in this case such that the $SiO_2$ development (that is to say, the evaporation of $SiO_2$ or the formation of quartz vapor) is minimized. Experiments showed that an irradiation period can lie in the range of between 2 to 20 seconds given a laser power of between 300 and 2500 watts.

The laser power can be reduced in stages during the irradiation period in order to minimize further the $SiO_2$ development. It was possible in principle to establish that the $SiO_2$ formation can be reduced in conjunction with falling laser power and, at the same time, a somewhat longer irradiation period.

After the pinch region has been heated, the shaping pinching jaws 60, 62 (dashed and dotted in FIG. 6) are closed and the pinch illustrated in FIGS. 1 to 3, or another geometry, is formed.

In order to remove the $SiO_2$ vapor produced during heating, it is also possible to provide a further evacuation in the pressure chamber 38 with the aid of an evacuation tube. The evacuation tube is directed toward the region to be heated, for example, the pinch, in order to evacuate the quartz vapor produced during heating.

There are disclosed a method and an apparatus for producing a lamp, and also a lamp produced using this method, in the case of which a lamp bulb closed at one end is filled through a feed opening for a luminous means. It is thereby possible to design a dome of the lamp bulb to be smooth without a pumping tip.

What is claimed is:

1. A method for producing a lamp, preferably an incandescent lamp pinched at one end, having a lamp bulb, into which a luminous means and supply leads are inserted through a feed opening, the lamp bulb being sealed by pinching the region of the feed opening, wherein the filling of the lamp bulb is performed through the feed opening before the pinching;

in which the filling and pinching are carried out in a pressure vessel;

in which the pinch region is heated to the deformation temperature by high-energy radiation;

in which the laser beam sweeps a beam profile that corresponds to the pinch region; and in which the energy input rises toward the feed opening and toward a clamping point for the lamp bulb.

2. A method for producing a lamp, preferably an incandescent lamp pinched at one end, having a lamp bulb, into which a luminous means and supply leads are inserted through a feed opening, the lamp bulb being sealed by pinching the region of the feed opening, wherein the filling of the lamp bulb is performed through the feed opening before the pinching:

in which the filling and pinching are carried out in a pressure vessel:

in which the pinch region is heated to the deformation temperature by high-energy radiation: and in which the laser power is reduced after a predetermined irradiation period.

* * * * *